US011499753B2

(12) United States Patent
Ewert et al.

(10) Patent No.: US 11,499,753 B2
(45) Date of Patent: Nov. 15, 2022

(54) PARAMETRICALLY OPTIMIZED FLAMELESS HEATER SYSTEM TO GENERATE HEAT

(71) Applicant: Anderson Industries, LLC, Webster, SD (US)

(72) Inventors: Daniel Ewert, Lake Park, MN (US); Timothy Springer, Fargo, MN (US)

(73) Assignee: Anderson Industries, LLC, Webster, SD (US)

( * ) Notice: Subject to any disclaimer, the term of this patent is extended or adjusted under 35 U.S.C. 154(b) by 201 days.

(21) Appl. No.: 16/660,155

(22) Filed: Oct. 22, 2019

(65) Prior Publication Data

US 2020/0132338 A1 Apr. 30, 2020

Related U.S. Application Data

(60) Provisional application No. 62/751,410, filed on Oct. 26, 2018.

(51) Int. Cl.

| | |
|---|---|
| ***F24H 9/20*** | (2022.01) |
| ***F24H 3/02*** | (2022.01) |
| ***F24H 9/14*** | (2006.01) |
| ***F24H 3/04*** | (2022.01) |
| *F24H 9/00* | (2022.01) |

(52) U.S. Cl.

CPC ..... *F24H 9/2085* (2013.01); *F24H 3/025* (2013.01); *F24H 3/0488* (2013.01); *F24H 9/142* (2013.01); *F24H 9/0073* (2013.01); *F24H 2240/06* (2013.01)

(58) Field of Classification Search

None

See application file for complete search history.

(56) References Cited

U.S. PATENT DOCUMENTS 2,949,047 A * 8/1960 Burckhardt ..... F16H 47/06 74/731.1
3,818,754 A * 6/1974 Asmus ..... G01L 3/20 73/862.16
3,851,524 A * 12/1974 Liu ..... G01L 3/20 73/862.16
4,427,150 A * 1/1984 van Basshuysen ..... B60H 1/03 123/142.5 E (Continued)

FOREIGN PATENT DOCUMENTS

DE 2916870 A1 11/1980

OTHER PUBLICATIONS

Transmittal of the International Search Report and Written Opinion of the International Searching Authority dated Jan. 22, 2020, for International Application No. PCT/US2019/057661, filed Oct. 23, 2019, pp. 10.

(Continued)

*Primary Examiner* — Avinash A Savani
*Assistant Examiner* — Deepak A Deean
(74) *Attorney, Agent, or Firm* — Womble Bond Dickinson (US) LLP

(57) ABSTRACT

The flameless heater system includes an energy source comprising a diesel engine configured to create volumes of air, a hydraulic system to control engine loading for heat generation and for air moving, and a control system, operatively coupled with the energy source and the hydraulic system to control at least one of a speed of the diesel engine, a loading of the diesel engine, or a fan speed.

12 Claims, 8 Drawing Sheets

(56) References Cited

U.S. PATENT DOCUMENTS 4,480,592 A * 11/1984 Gokcen ..... F24V 40/00 122/26
4,688,419 A * 8/1987 D'Angelo ..... G01M 17/0072 73/116.06
5,145,038 A * 9/1992 Kuwahara ..... H02K 49/043 188/158
5,452,605 A * 9/1995 Wilson ..... G01M 17/0072 73/116.06
5,755,379 A * 5/1998 Ito ..... B60H 1/00978 237/12.3 R
5,816,495 A * 10/1998 Ito ..... F24V 40/00 237/12.3 R
5,829,676 A * 11/1998 Ban ..... F24V 40/00 123/41.15
10,065,507 B1 * 9/2018 Lerner ..... B61H 7/083
2012/0312074 A1 * 12/2012 Allmendinger .... G01N 15/0656 73/23.31
2015/0176859 A1 6/2015 Hoffert
2016/0161147 A1 * 6/2016 Lorenson ..... F24H 3/06 123/41.49
2016/0209081 A1 * 7/2016 Mencel ..... F24V 40/10

OTHER PUBLICATIONS

Transmittal of International Preliminary Report on Patentability dated May 6, 2021, for International Application No. PCT/US2019/057661, filed Oct. 23, 2019, pp. 9.
International Search Report and Written Opinion for PCT Application No. PCT/US2019/057661, filed Oct. 23, 2019, 10 pages.

* cited by examiner

PARAMETRICALLY OPTIMIZED FLAMELESS HEATER SYSTEM TO GENERATE HEAT

CROSS REFERENCE TO RELATED APPLICATIONS

This application claims the benefit of an earlier filing date of U.S. Provisional Patent Application No. 62/751,410, filed on Oct. 26, 2018, the disclosure of which is incorporated herein by reference in its entirety.

TECHNICAL FIELD

Aspects and implementations of the present disclosure relate to flameless heater systems.

BACKGROUND

Flameless heaters have been used to provide heat in harsh and potentially hazardous conditions. These heaters must be able to operate in extreme conditions for extended periods of time without operator control and monitoring, in various temperatures and weather conditions. The requirement of flameless heat is essential in certain locations, as wellhead gases may be volatile and an ignition source, such as a spark or open flame, could set off an uncontrolled fire.

BRIEF DESCRIPTION OF THE DRAWINGS

Embodiments and implementations of the present disclosure will be understood more fully from the detailed description given below and from the accompanying drawings of various aspects and implementations of the disclosure, which, however, should not be taken to limit the disclosure to the specific embodiments or implementations, but are for explanation and understanding only.

DETAILED DESCRIPTION

Figure 1:
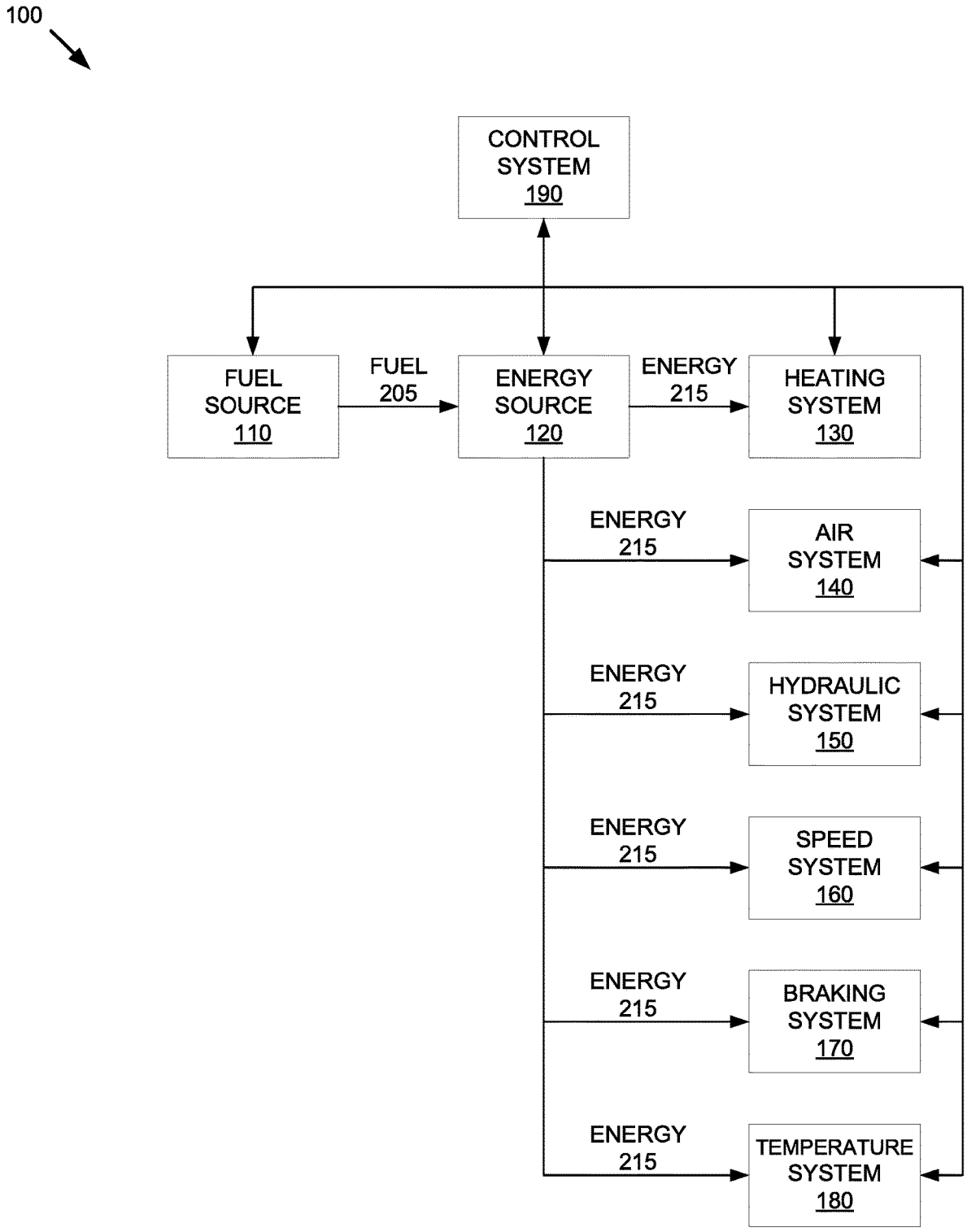
FIG. 1 illustrates a configuration of a flameless heater system in accordance with embodiments of the present disclosure.

Aspects and implementations of the present disclosure are directed to a flameless heater system. Flameless heaters are used to provide heat in harsh and potentially hazardous environments, such as oil fields or grain drying. Flameless heaters operate in environments that include volatile gasses that may be ignited by an ignition source, such as a spark or an open flame. The use of flameless heaters in such environments reduce the risk of explosions or uncontrolled fires by providing heat without the use of an ignition source.

One example of a flameless heater system utilizes an internal combustion engine to drive a fluid based heat generator. The heat generator shears a fluid, causing the fluid to heat. The heated fluid is then circulated through hoses using an engine-driven pump to a storage tank. The heated fluid is then transferred from the storage tank to a fluid-to-air heat exchanger, where the heat is extracted from the heated fluid. Another example of a flameless heater system utilizes an internal combustion engine to drive a fan while moving magnets to create heat.

However, the delay between the startup of a conventional flameless heater and the ability to produce full capacity heated air flow is considerable. At the time of startup, the engine block and fluids are cold, and time is needed to warm the engine block and engine fluids to operating temperatures. Furthermore, while the engine block and fluids are warming, an air mover is distributing air from the heater assembly, effectively cooling the engine block. Also, without having the ability to regulate the flow of hydraulic fluid, more time is needed for the fluid to reach operational conditions. Accordingly, a conventional flameless heater system that takes a considerable amount of time to reach operating temperatures may not be suitable for time dependent heating purposes.

Embodiments of the present disclosure address the issues of conventional flameless heater systems by implementing systems and controls to reduce the time needed to generate heated air produced by a flameless heater system. By utilizing an independent heating system, thermal energy may be produced from converting energy provided by an energy source. The use of an independent air system allows for the flow of to be controlled to hamper the air's ability to cool the engine block before operating temperatures are reached. The use of an independent hydraulic system allows the flow of hydraulic fluid to be controlled to lessen the fluid's ability to cool the engine block before operating temperatures are reached. Additionally, by using both an independent speed system and an independent braking system, engine loading may be controlled to adjust the engine's power output. The use of an independent temperature system allows temperatures in various locations of the flameless heater system to be controlled to local, remote, and telemetry-based user parameters. The result is an improved flameless heater system that generates heat, improving the performance of the flameless heater system, and allows the flameless heater system to be used in various processes, where a conventional flameless heater system may take too long to adequately preform its function.

In embodiments, flameless heaters may be placed in different operating conditions that require the same air flow rate but at a much different static pressures. The control system can adjust the rotational speed of a fan to achieve the same airflow over a range of static pressures by increasing or reducing the output of a hydraulic motor. Thus once the user selects the desired air temperature for the heater outlet air, the control system can maintain that temperature despite a host of changes in operating conditions, such as inlet air temperature, static pressure demand, fuel burn rate, etc., further improving the performance of the flameless heater system.

FIG. 1 illustrates a configuration of a flameless heater system 100 in accordance with embodiments of the present disclosure. The flameless heater system 100 may include a fuel source 110, an energy source 120, a heating system 130, an air system 140, a hydraulic system 150, a speed system 160, a braking system 170, a temperature system 180, and a control system 190.

The control system 190 may be operatively coupled to the fuel source 110, the energy source 120, the heating system 130, the air system 140, the hydraulic system 150, the speed system 160, the braking system 170, and the temperature system 180. The control system 190 may also be operatively coupled to one or more sensors, as will be described below at FIG. 2, that gather data on various parameters of flameless heater system 100. The control system 190 includes a processing device configured to monitor the various parameters of flameless heater system 100 and control various operations of flameless heater system 100. For example, the control system 190 may monitor the fuel level of fuel source 110, the power output of energy source 120, the heat output of heating system 130, the air velocity of air system 140, the fluid velocity of hydraulic system 150, the structure speed of speed system 160, the engine loading of braking system 170, the air temperature of temperature system 180, etc.

The energy source 120 converts fuel 205 from the fuel source 110 into energy. In embodiments, the energy source 120 may be an internal combustion engine. For example, the energy source 120 may be a diesel engine. In some embodiments, the energy source 120 may be a turbine engine. For example, the energy source 120 may be a jet engine.

The fuel source 110 is a storage system for the fuel that is to be provided to energy source 120. Examples of fuel sources may include, but are not limited to, storage tanks, containers, bladders, reservoirs and the like. The type of fuel stored at fuel source 110 may be based on the type of energy source 120 used by the flameless heater system 100. For example, if energy source 120 is a diesel engine, then fuel source 110 may store diesel fuel. The fuel source 110 is operatively coupled to the energy source 120 to provide fuel 205 from fuel source 110 to the energy source 120. For example, one or more hoses or tubes may be coupled between the fuel source 110 and the energy source 120 to provide the fuel 205 to the energy source 120. In embodiments, one or more pumps may be utilized to move the fuel 205 from the fuel source 110 to the energy source 120.

Upon receipt of the fuel, the energy source 120 converts the fuel into energy, as previously described. The energy generated by the energy source 120 may be provided to a heating system 130 that is operatively coupled to the energy source 120. The heating system 130 may be configured to convert the energy received from energy source 120 into thermal energy (e.g., heat).

In embodiments, the heating system 130 may be a radiant heater that emits infrared radiation. In an embodiment, the heating system 130 may be a convection heater that utilizes a heating element to heat the air in contact with the heating element by thermal conduction. In some embodiments, the heating system 130 may be a heat pump that utilizes an electrically driven compressor to operate a refrigeration cycle that extracts heat energy from outdoor air, the ground or ground water, and moves the heat into the space to be warmed. In embodiments, the heating system 130 may be an electrical resistance heating element. In some embodiments, the heating system 130 may be a fluid based heat generator configured to shear a fluid to generate heat. In embodiments, the heating system 130 may be an induction heater configured to generate heat by electromagnetic induction. In an embodiment, the heating system 130 may be any device that converts energy generated by energy source 120 into thermal energy.

The energy generated by energy source 120 may further be provided to an air system 140 operatively coupled to energy source 120. The air system 140 may be configured to utilize the energy provided by energy source 120 to alter airflow of the flameless heater system 100. In embodiments, air system 140 may be a fan configured to utilize the energy provided by the energy source 120 to produce air flow that is introduced into the flameless heater system 100. In some embodiments, the air system 140 may be rotating structure configured to control airflow of the flameless heater system 100. In embodiments, other types of air systems may be utilized by the flameless heater system 100.

The energy generated by energy source 120 may further be provided to a hydraulic system 150 operatively coupled to energy source 120. The hydraulic system 150 may be configured to utilize the energy provided by energy source 120 to control the flow of hydraulic fluid used in flameless heater system 100. In embodiments, hydraulic system 150 may be a pump configured to utilize the energy provided by the energy source 120 to regulate hydraulic fluid flow that is introduced into the flameless heater system 100. In some embodiments, the hydraulic system 150 may comprise valves to regulate hydraulic fluid flow that is introduced into the flameless heater system 100. In embodiments, other types of hydraulic systems may be utilized by the flameless heater system 100.

The energy generated by energy source 120 may further be provided to a speed system 160 that is operatively coupled to energy source 120. The speed system 160 may be configured to utilize the energy provided by energy source 120 to control the speed of rotating structure used in flameless heater system 100. In embodiments, speed system 160 may include a variable speed drive configured to utilize the energy provided by the energy source 120 to control rotating disks within the flameless heater system 100. In embodiments, other types of speed systems may be utilized by the flameless heater system 100.

The energy generated by energy source 120 may further be provided to a braking system 170 that is operatively coupled to energy source 120. The braking system 170 may be configured to utilize the energy provided by energy source 120 to produce engine loading in flameless heater system 100. In embodiments, braking system 170 may be an actuator configured to utilize the energy provided by the energy source 120 to adjust a magnetic field location with respect to rotating structure used in the flameless heater system 100. In embodiments, other types of braking systems may be utilized by the flameless heater system 100.

The energy generated by energy source 120 may further be provided to a temperature system 180 operatively coupled to energy source 120. The temperature system 180 may be configured to utilize the energy provided by energy source 120 to measure and control temperatures to local, remote, and telemetry-based user parameters used in flameless heater system 100. In embodiments, temperature system 180 may be a thermometer configured to determine one or more of an air inlet temperature, a cabinet temperature, a fan inlet temperature, a discharge air temperature, or a remote probe temperature within flameless heater system 100. In some embodiments, temperature system 180 may be a resistance temperature detector configured to determine one or more of an air inlet temperature, a cabinet temperature, a fan inlet temperature, a discharge air temperature, or a remote probe temperature within flameless heater system 100. In some embodiments, temperature system 180 may be a thermocouple configured to determine one or more of an air inlet temperature, a cabinet temperature, a fan inlet temperature, a discharge air temperature, or a remote probe temperature within flameless heater system 100. In embodiments, other types of temperature systems may be utilized by the flameless heater system 100.

Figure 2:
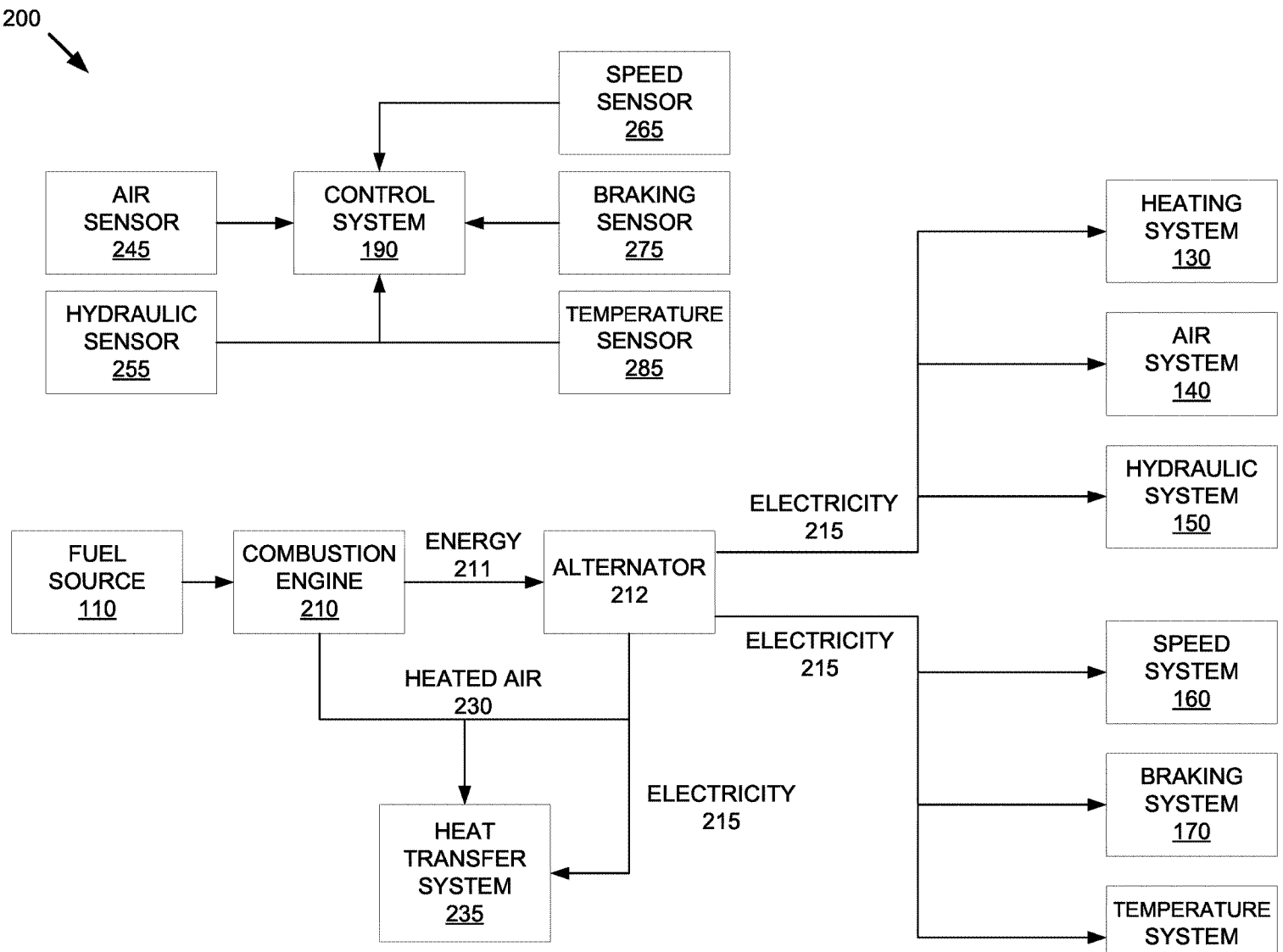
FIG. 2 illustrates a configuration of a flameless heater system utilizing an internal combustion engine energy source in accordance with one embodiment of the present disclosure.

FIG. 2 illustrates a configuration of a flameless heater system 200 utilizing an internal combustion engine energy source in accordance with one embodiment of the present disclosure. The flameless heater system 200 includes fuel source 110, heating system 130, air system 140, hydraulic system 150, speed system 160, braking system 170, temperature system 180, and control system 190, as previously described at FIG. 1.

The fuel source 110 may be operatively coupled to an internal combustion engine 210 to provide fuel stored at the fuel source 110 to the internal combustion engine 210. In embodiments, the internal combustion engine 210 may be a reciprocating engine, such as a diesel engine. In some embodiments, the internal combustion engine 210 may be a turbine engine, such as a jet engine. The internal combustion engine 210 may generate energy 211 using the fuel provided by fuel source 110, as previously described. Another byproduct of the generation of energy 211 by the combustion engine 210 may be thermal energy (e.g., heated air 230).

In embodiments, an alternator 212 may be operatively coupled to the internal combustion engine 210. The alternator 212 may convert the energy 211 produced by the internal combustion engine 210 into electricity 215. In some embodiments, other types of generators may be utilized by the flameless heater system 200 to produce electricity for the various systems of flameless heater system 200.

In some embodiments, the heated air 230 that is the result of the reaction that takes place in the internal combustion engine 210 and/or the use of the alternator 212 may also be used as a heat source to supplement the heat generated by heating system 130. The heated air 230 may be provided to a heat transfer system 235 operatively coupled to the combustion engine 210 and/or the alternator 212. The heat transfer system 235 may be configured to move the heated air 230 from the internal combustion engine 210 and/or the alternator 212 to a desired location. In an embodiment, the heat transfer system 235 may include one or more fans that are configured to move the heated air 230. In embodiments, the heat transfer system 235 may include one or more pumps that are configured to move the heated air 230. In embodiments, electricity 215 generated by the alternator 212 may be provided to the heat transfer system 235 to power various components of the heat transfer system 235. For example, the electricity 215 may be used to power the fans, pumps, etc. of the heat transfer system 235. In some embodiments, the heated air 230 moved by the heat transfer system may be combined in the outflow airstream of the flameless heater system 200 with the heat generated by heating system 130.

In embodiments, heating system 130 may be operatively coupled to combustion engine 210. Energy 211 that is the result of the reaction that takes place in the internal combustion engine 210 may be provided from the internal combustion engine 210 to the heating system 130. The heating system 130 may be operatively coupled to the alternator 212 to receive the energy 211 generated by the internal combustion engine 210 as electricity 215 to produce thermal energy within the flameless heater system 200, as previously described.

In embodiments, air system 140 may be operatively coupled to internal combustion engine 210. Energy 211 that is the result of the reaction that takes place in the internal combustion engine 210 may be provided from the internal combustion engine 210 to the air system 140. The air system 140 may be operatively coupled to the alternator 212 to receive the energy 211 generated by the internal combustion engine 210 as electricity 215 to measure and regulate the outflow airstream of the flameless heater system 200, as previously described.

In embodiments, hydraulic system 150 may be operatively coupled to combustion engine 210. Energy 211 that is the result of the reaction that takes place in the internal combustion engine 210 may be provided from the internal combustion engine 210 to the hydraulic system 150. The hydraulic system 150 may be operatively coupled to the alternator 212 to receive the energy 211 generated by the internal combustion engine 210 as electricity 215 to measure and regulate the flow of hydraulic fluid of the flameless heater system 200, as previously described.

In embodiments, speed system 160 may be operatively coupled to combustion engine 210. Energy 211 that is the result of the reaction that takes place in the internal combustion engine 210 may be provided from the internal combustion engine 210 to the speed system 160. The speed system 160 may be operatively coupled to the alternator 212 to receive the energy 211 generated by the internal combustion engine 210 as electricity 215 to control the speed of rotating structure within the flameless heater system 200, as previously described.

In embodiments, braking system 170 may be operatively coupled to combustion engine 210. Energy 211 that is the result of the reaction that takes place in the internal combustion engine 210 may be provided from the internal combustion engine 210 to the braking system 170. The braking system 170 may be operatively coupled to the alternator 212 to receive the energy 211 generated by the internal combustion engine 210 as electricity 215 to produce engine loading in the flameless heater system 200, as previously described.

In embodiments, temperature system 180 may be operatively coupled to combustion engine 210. Energy 211 that is the result of the reaction that takes place in the internal combustion engine 210 may be provided from the internal combustion engine 210 to the temperature system 180. The temperature system 180 may be operatively coupled to the alternator 212 to receive the energy 211 generated by the internal combustion engine 210 as electricity 215 to measure and control temperatures to local, remote, and telemetry-based user parameters used in the flameless heater system 200, as previously described.

Flameless heater system 200 may include one or more air sensors 245. In embodiments, the air sensor 245 may be configured to measure the velocity of air in a volume of space within the flameless heater system 200. In some embodiments, the air sensor 245 may be configured to detect the quality of air (such as measuring the amount of ozone, atmospheric particulate matter, carbon monoxide, etc.) in a volume of space within the flameless heater system 200. The air sensor 245 may be operatively coupled to the control system 190 to provide the measured velocity and/or air quality to the control system 190. The control system 190 may utilize the measured velocity and/or air quality to adjust parameters and/or operations of the flameless heater system 200, as will be described in further detail below.

Flameless heater system 200 may further include one or more hydraulic sensors 255. In embodiments, the hydraulic sensor 255 may be configured to measure the velocity of fluid in a volume of space within the flameless heater system 200. In some embodiments, the hydraulic sensor 255 may be configured to measure the pressure of hydraulic fluid in a volume of space within the flameless heater system 200. In some embodiments, the hydraulic sensor 255 may be configured to monitor the amount of fluid in a volume of space within the flameless heater system 200. The hydraulic sensor 255 may be operatively coupled to the control system 190 to provide the measured velocity, pressure, and/or amount of the hydraulic fluid to the control system 190. The control system 190 may utilize the measured velocity, pressure, and/or amount of the hydraulic fluid to adjust parameters and/or operations of the flameless heater system 200, as will be described in further detail below.

Flameless heater system 200 may further include one or more speed sensors 265. In embodiments, the speed sensor 265 may be configured to measure a speed of the rotating structure within the flameless heater system 200. The speed sensor 265 may be operatively coupled to the control system 190 to provide the measured velocity to the control system 190. The control system 190 may utilize the measured velocity to adjust parameters and/or operations of the flameless heater system 200, as will be described in further detail below.

Flameless heater system 200 may further include one or more braking sensors 275. In embodiments, the braking sensor 275 may be configured to measure the amount of engine loading produced within the flameless heater system 200. The braking sensor 275 may be operatively coupled to the control system 190 to provide the amount of engine loading to the control system 190. The control system 190 may utilize the amount of engine loading to adjust parameters and/or operations of the flameless heater system 200, as will be described in further detail below.

Flameless heater system 200 may further include one or more temperature sensors 285. In embodiments, the temperature sensor 265 may be configured to measure a temperature of a volume of space being heated by the flameless heater system 200. In some embodiments, such measurements may include one or more of an air inlet temperature, a cabinet temperature, a fan inlet temperature, a discharge air temperature, or a remote probe temperature. The temperature sensor 285 may be operatively coupled to the control system 190 to provide the measured temperature(s) to the control system 190. The control system 190 may utilize the measured temperature(s) to adjust parameters and/or operations of the flameless heater system 200, as will be described in further detail below.

Figure 3:
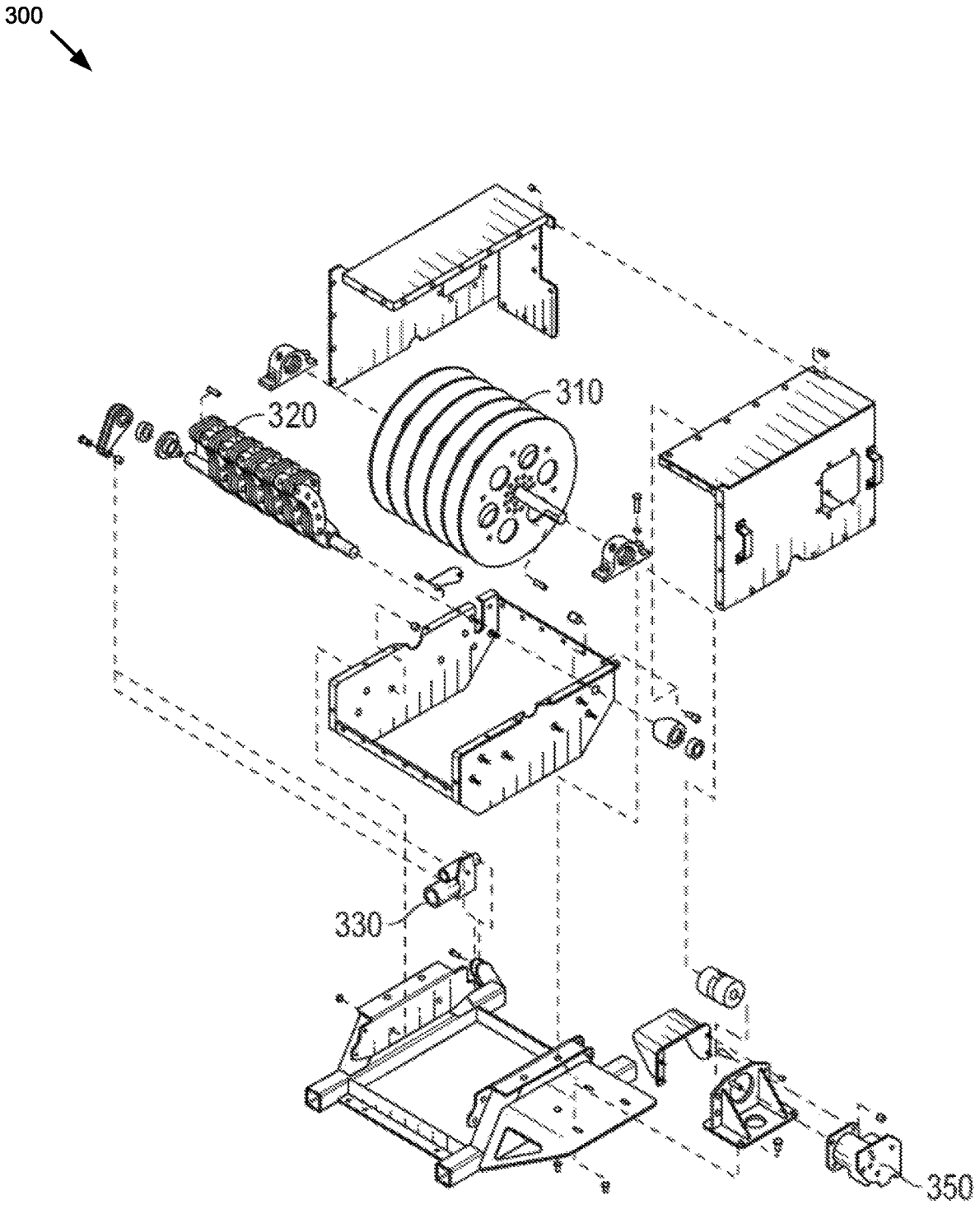
FIG. 3 illustrates an example of an engine loading and variable braking system in accordance with one embodiment of the present disclosure.

FIG. 3 illustrates an example of an engine loading and variable braking system 300 in accordance with one embodiment of the present disclosure. In embodiments, variable braking system 300 may correspond to braking system 170 of FIG. 1. Variable braking system 300 includes a magnet arm actuator 330 and a pivoting magnet arm 320 configured to adjust a magnetic field location with respect to rotating structure. In the FIG. 3 embodiment, the rotating structure is rotating disks 310. In embodiments, the rotating disks 310 may be interleaved between the magnets of the pivoting magnet arm 320 such that each of the rotating disks 310 is positioned between a pair of magnets of the pivoting magnet arm 320. The magnet arm actuator 330 may be used to move the pivoting magnet arm 320 into a desired position relative to the rotating disks 310 to generate a magnetic field that functions as a braking mechanism for the rotating disks 310. For example, the magnet arm actuator 330 may move the pivoting magnet arm 320 to a position that is closer to the rotating disks 310, increasing the magnetic forces exerted on the rotating disks 310, to increase the braking forces exerted on rotating disks 310. In the embodiment, speed system 160 comprises a variable speed hydraulic motor for magnetic engine loader (MEL) 350 to control the speed of the rotating disks 310 independently from other parameters of the flameless heater system 200. In the embodiment, a result is the ability to produce an engine loading using the magnetic braking assembly, controlled by a variable braking system, while independently controlling the speed of the rotating disks using a variable speed drive system.

Figure 4:
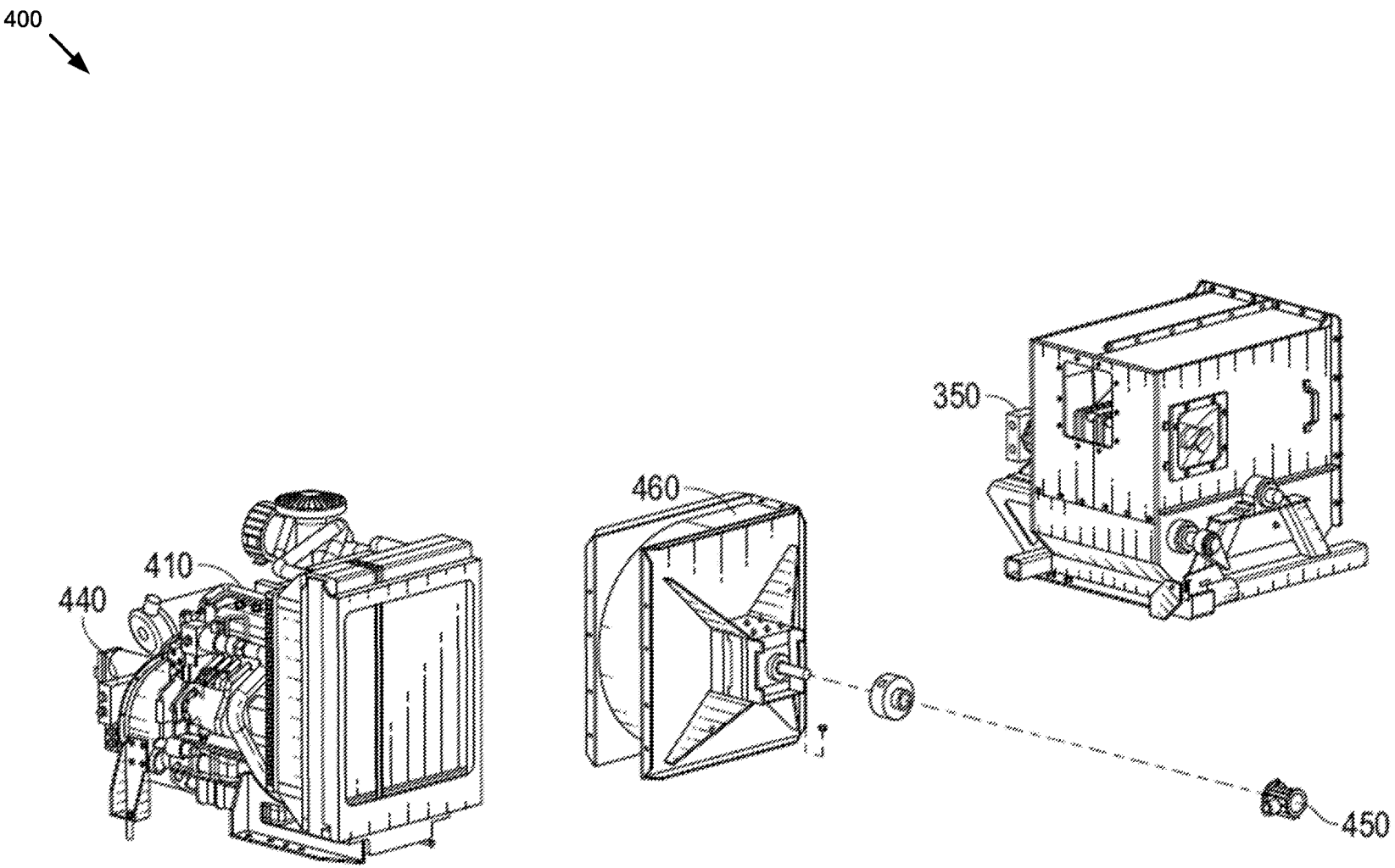
FIG. 4 illustrates an example of a variable speed drive system and an air system in accordance with one embodiment of the present disclosure.

FIG. 4 is an illustration 400 an example of a variable speed drive system and an air system in accordance with one embodiment of the present disclosure. In FIG. 4, a variable speed hydraulic fan motor 450 allows air system 140 to independently control the air flow of the flameless heater system 200. In an embodiment, the variable speed hydraulic fan motor 450 may be mounted to a fan 460 that would enable the air flow of flameless heater system 200 to be controlled by air system 140. By increasing or decreasing the output of the variable speed hydraulic fan motor 450, the rotational speed of fan 460 may achieve the same airflow over a range of static pressures. Additionally, the embodiment discloses two separate hydraulic pumps 440 that are attached to a diesel engine 410. In some embodiments, the diesel engine may correspond to energy source 120 of FIG. 1 or internal combustion engine 210 of FIG. 2. Although described as having two hydraulic pumps coupled to the diesel engine, embodiments of the disclosure may utilize any number of hydraulic pumps. In this embodiment, the hydraulic pumps 440 function to independently control the fuel burn rate of the flameless heater system 200. The FIG. 4 embodiment also includes the variable speed hydraulic motor for MEL 350. The variable speed hydraulic motor may allow for the adjustment of the rotational speed of the rotating disks 310 of FIG. 3, as previously described at FIG. 3. In embodiments, the variable speed hydraulic motor for MEL 350 may be used in conjunction with the variable braking system 300 of FIG. 3 to control engine loading using the magnetic braking assembly.

Figure 5:
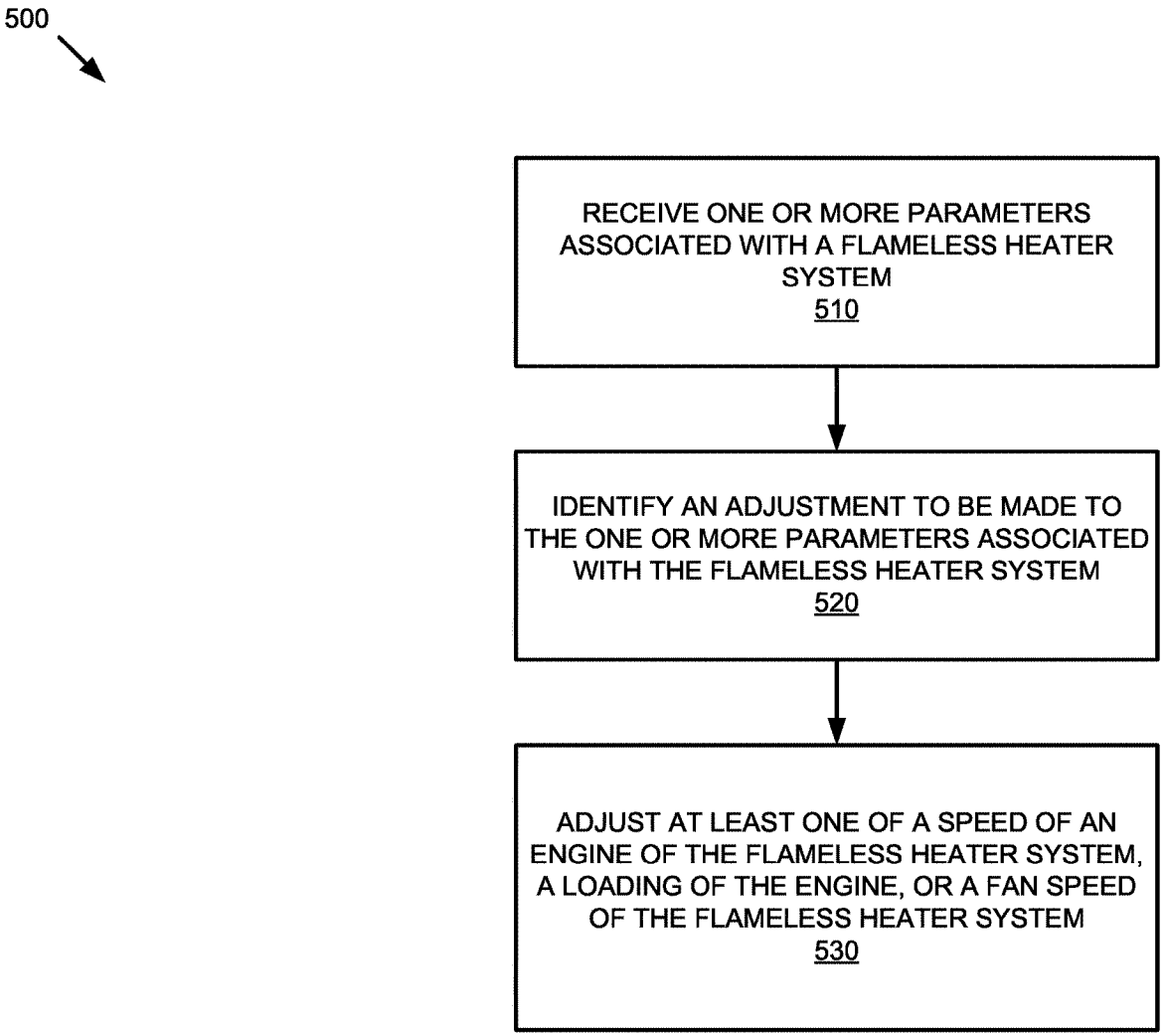
FIG. 5 depicts a flow diagram of a method for utilizing a flameless heater to generate heat in accordance with one embodiment of the present disclosure.

FIG. 5 depicts a flow diagram of a method 500 for utilizing a flameless heater to generate heat in accordance with one implementation of the present disclosure. In embodiments, various portions of method 500 may be performed by flameless heater systems 100 or 200 of FIGS. 1 and 2, respectively.

With reference to FIG. 5, method 500 illustrates example functions used by various embodiments. Although specific function blocks ("blocks") are disclosed in method 500, such blocks are examples. That is, embodiments are well suited to performing various other blocks or variations of the blocks recited in method 500. It is appreciated that the blocks in method 500 may be performed in an order different than presented, and that not all of the blocks in method 500 may be performed.

At block 510, a control system (e.g., processing device 802) receives parameters associated with the flameless heater system. In an embodiment, the parameters may be a temperature, a velocity, a pressure, a distance, engine revolutions per minute (RPM), or a fuel burn rate.

At block 520, the control system identifies an adjustment to be made to the one or more parameters associated with the flameless heater system, as previously described.

At block 530, the control system adjusts at least one of a speed of an engine of the flameless heater system, a loading of the engine, or a fan speed of the flameless heater system. In some embodiments, the speed of the engine may be adjusted via the hydraulics system, which regulates the fuel burn rate of the flameless heater system through hydraulic pumps 440. To adjust engine loading, in embodiments, the speed system may be used to control the speed of rotating structure within the flameless heater system, and/or the braking system may use an actuator to adjust the distance between a pivoting magnetic arm and the rotating structure. In some embodiments, the rotating structure's speed is regulated by a variable speed hydraulic motor 350 that is controlled by the hydraulics system. In some embodiments, the fan speed may be adjusted via the air system, which may distribute air from the heater assembly by altering the airflow of the flameless heater system using a fan 460. In some embodiments, the fan speed may be regulated by a variable speed hydraulic fan motor 450 that is controlled by the hydraulics system.

Figure 6:
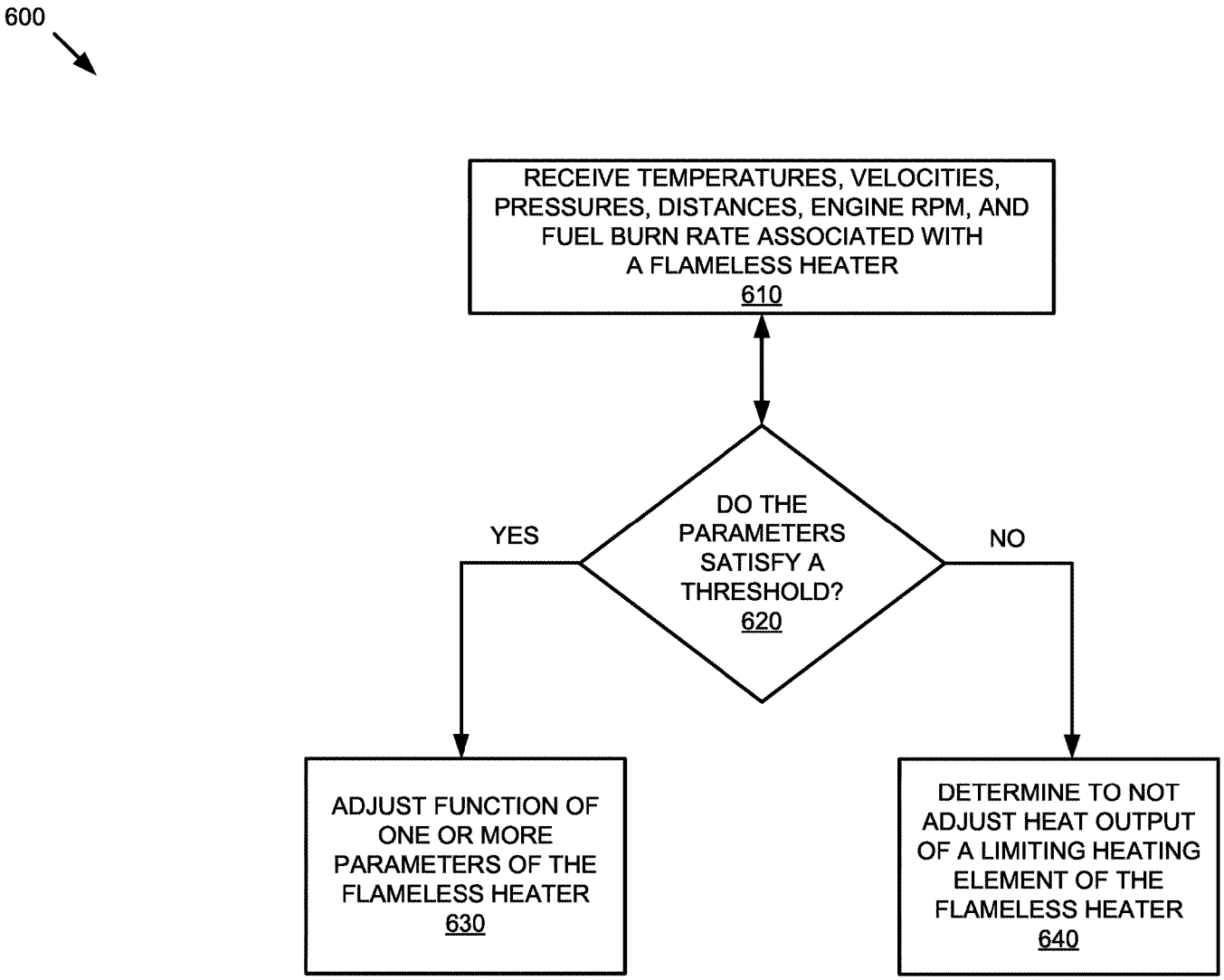
FIG. 6 depicts a flow diagram of a method for controlling a flameless heater system by optimizing parameters in accordance with embodiments of the present disclosure.

FIG. 6 depicts a flow diagram of a method 600 for controlling a flameless heater system in accordance with implementations of the present disclosure. In embodiments, various portions of method 600 may be performed by control system 190 of FIGS. 1-2.

With reference to FIG. 6, method 600 illustrates example functions used by various embodiments. Although specific function blocks ("blocks") are disclosed in method 600, such blocks are examples. That is, embodiments are well suited to performing various other blocks or variations of the blocks recited in method 600. It is appreciated that the blocks in method 600 may be performed in an order different than presented, and that not all of the blocks in method 600 may be performed.

At block 610, a control system (e.g., processing device 802) receives parameters (e.g., temperatures, velocities, pressures, distances, engine RPM, fuel burn rate, etc.) associated with a flameless heater. In embodiments, the control system may receive the temperature from one or more temperature sensors of a flameless heater system. In an embodiment, the temperature may correspond to a temperature of a volume of space that is being heated by the flameless heater system. For example, the temperature may correspond to the temperature of a room being heated by the flameless heater system. In some embodiments, the control system may receive the velocity from one or more air sensors of the flameless heater system. In embodiments, the velocity may correspond to a speed of the volume of space that is being targeted by the flameless heater system. In some embodiments, the control system may receive the velocity from one or more hydraulic sensors of the flameless heater system. In embodiments, the velocity may correspond to a speed of the fluid that is being targeted by the flameless heater system. In an embodiment, the control system may receive the velocity from one or more speed sensors of the flameless heater system. In embodiments, the velocity may correspond to a speed of rotating structure that is being targeted by the flameless heater system. In some embodiments, the control system may receive the engine power output from one or more braking sensors of the flameless heater system. In embodiments, the power output may correspond to the engine fuel burn rate that is being targeted by the flameless heater system.

At block 620, the control system determines if the parameters received at block 610 satisfy a threshold. In embodiments, one threshold may correspond to a temperature value. In embodiments, the temperature may satisfy the threshold if the temperature is greater than or equal to the threshold. For example, if the threshold is 72 degrees and the temperature received at block 610 is 75 degrees, then the temperature satisfies the threshold. In some embodiments, the temperature may satisfy the threshold if the temperature is less than or equal to the threshold. For example, if the threshold is 72 degrees and the temperature received at block 610 is 68 degrees, then the temperature satisfies the threshold. In an embodiment, multiple thresholds may be used to create a range of temperatures. For example, a first threshold may be used that specifies a temperature less than or equal to 65 degrees satisfies the first threshold and a second threshold may be used that specifies a temperature greater than or equal to 75 degrees satisfies the second threshold. Accordingly, if the received temperature is outside of the specified temperature range (e.g., is less than or equal to 65 degrees or greater than or equal to 75 degrees), then the temperature satisfies the threshold.

In some embodiments, another threshold may correspond to a velocity value. In embodiments, the velocity may satisfy the threshold if the velocity is less than or equal to the threshold. In an embodiment, the velocity may satisfy the threshold if the velocity is greater than or equal to the threshold. For example, if the threshold is not to exceed 5 feet per second and the velocity received at block 610 is 2 feet per second, then the velocity satisfies the threshold. In some embodiments, the velocity may satisfy the threshold if the temperature is greater than or equal to the threshold. For example, if the threshold is 10 feet per second and the velocity received at block 610 is 12 feet per second, then the temperature satisfies the threshold. In an embodiment, multiple thresholds may be used to create a range of velocities. For example, a first threshold may be used that specifies a velocity less than or equal to 3 feet per second satisfies the first threshold and a second threshold may be used that specifies a velocity greater than or equal to 15 feet per second satisfies the second threshold. Accordingly, if the received velocity is outside of the specified velocity range (e.g., is less than or equal to 3 feet per second or greater than or equal to 15 feet per second), then the velocity satisfies the threshold.

In some embodiments, another threshold may correspond to an engine loading value. In embodiments, the engine loading value may satisfy the threshold if the braking system's output is less than or equal to the threshold. In an embodiment, the engine loading value may satisfy the threshold if it is less than or equal to the threshold. For example, if the threshold is not to exceed a set distance measured between the pivoting magnet arm and the rotating structure and distance received is less than the threshold, then the loading value satisfies the threshold resulting in less breaking output and greater engine loading. In some embodiments, the loading value may satisfy the threshold if the distance is greater than or equal to the threshold. For example, if the threshold is to exceed a set distance measured between the pivoting magnet arm and the rotating structure and distance received is greater than the threshold, then the loading value satisfies the threshold resulting in more breaking output and less engine loading. In an embodiment, multiple thresholds may be used to create a range of loading values. For example, a first threshold may be used that specifies a distance measured between the pivoting magnet arm and the rotating structure satisfies the first threshold and a second threshold may be used that specifies a larger distance measured between the pivoting magnet arm and the rotating structure satisfies the second threshold. Accordingly, if the received loading value is outside of the specified distance range (e.g., is less than one distance or greater than or equal to a larger distance), then the engine loading satisfies the threshold.

In some embodiments, multiple thresholds may be used for other parameters. For example, the control system may utilize a temperature threshold corresponding to a temperature value and a velocity threshold corresponding to a velocity value. In embodiments, the threshold may be provided via a user interface of the control system. In some embodiments, the threshold may be provided via a temperature regulating device, such as a thermostat.

In embodiments, other thresholds may correspond to a pressure, an engine RPM, or a fuel burn rate value. If the temperature, velocity, pressure, engine RPM, and fuel burn rate satisfy their respective thresholds, at block 630 the control system adjusts the heat output of a heating system and/or the velocity output of an air, hydraulic, speed system and/or the engine power output of a breaking system of the flameless heater system. For example, if the temperature received at block 610 is too high (e.g., is greater than the threshold at block 620), then the control system may decrease the heat output of the heating system or choose to modify the engine power output through the braking system. In another example, if the temperature received at block 610 is too low (e.g., is less than the threshold at block 620), then the control system may increase the heat output of the heating system. The control system would also have the option to support the increase in heat output by reducing one or more fan speeds, controlled by the air system, or reducing the flow of hydraulic fluid, controlled by the hydraulic system.

In embodiments, if the velocity of hydraulic fluid is too high, then the control system may determine to decrease the velocity output of the hydraulic system by opening, closing, or throttling one or more valves within the flameless heater system. In another embodiment, if the velocity of hydraulic fluid is too low, then the control system may determine to increase the velocity output of the hydraulic system by activating one or more pumps within the flameless heater system. In embodiments, if the velocity of air is too high, then the control system may determine to decrease the velocity output of the air system by reducing the speed of one or more fans within the flameless heater system. In some embodiments, the one or more fan speeds may be reduced to zero. In another embodiment, if the velocity of air is too low, then the control system may determine to increase the velocity output of the air system by activating one or more fans within the flameless heater system.

If the control system determines the temperature, velocity, pressure, engine RPM, and/or fuel burn rate do not satisfy their respective thresholds, at block 640 the control system determines to not adjust parameters associated with the respective systems of the flameless heater system.

Figure 7:
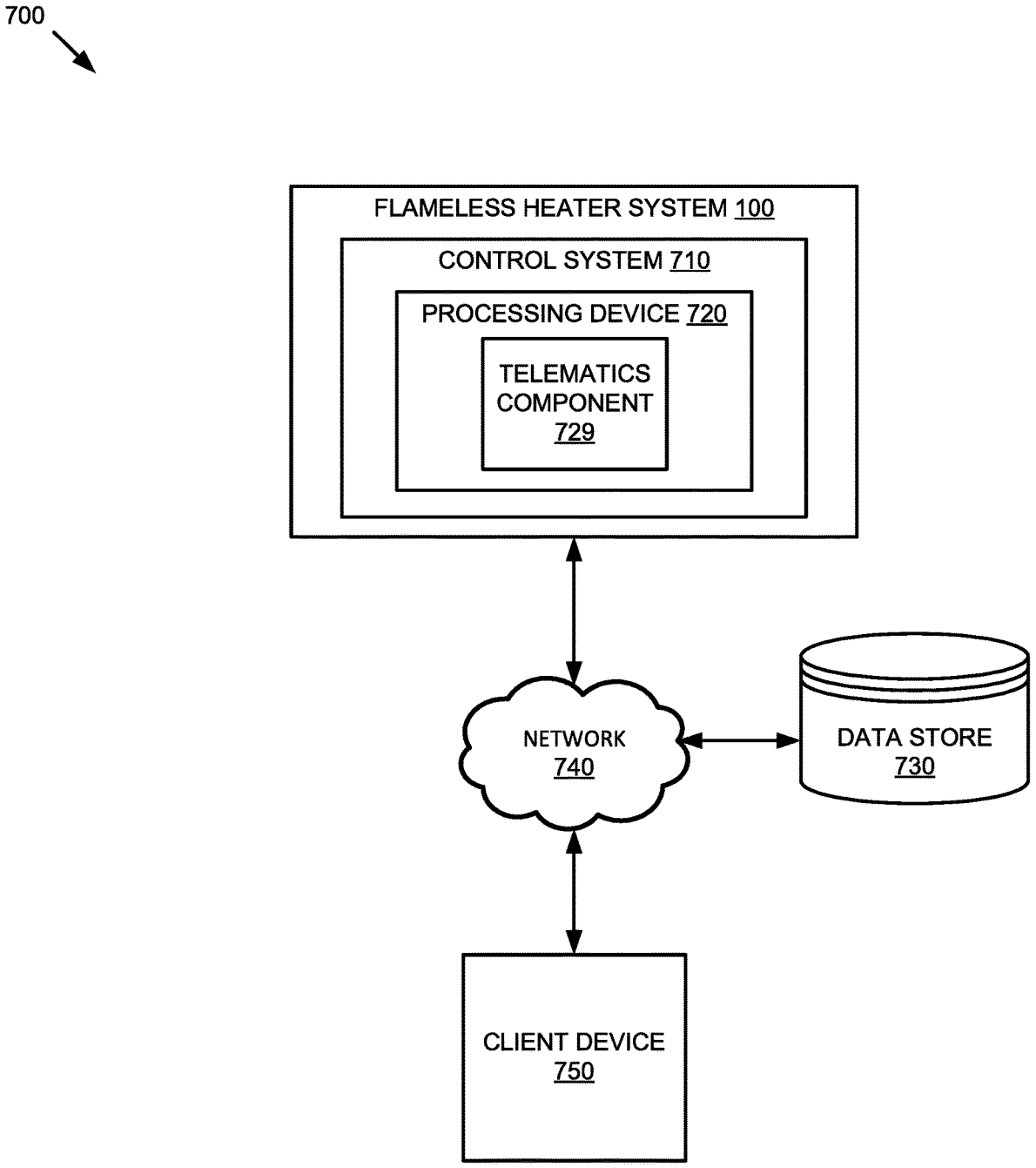
FIG. 7 is a block diagram that illustrates an example of a telematics system in accordance with an embodiment of the present disclosure.

FIG. 7 is a block diagram that illustrates an example of a telematics system 700, in accordance with an embodiment of the present disclosure. The telematics system 700 may include a control system 710 of a flameless heater system 100, as previously described with respect to FIGS. 1-4. The control system 710 includes a processing device 720 that executes a telematics component 729. In embodiments, the control system 710 may be operatively coupled to a data store 730 and a client device 750 via a network 740. In some embodiments, the data store 730 may reside in the control system 710.

The network 740 may be a public network (e.g., the internet), a private network (e.g., a local area network (LAN) or wide area network (WAN)), or a combination thereof. In one embodiment, network 740 may include a wired or a wireless infrastructure, which may be provided by one or more wireless communications systems, such as a wireless fidelity (WiFi) hotspot connected with the network 740 and/or a wireless carrier system that can be implemented using various data processing equipment, communication towers (e.g. cell towers), etc.

The client device 750 may be a computing device, such as a personal computer, laptop, cellular phone, personal digital assistant (PDA), gaming console, tablet, etc. In embodiments, the client device 750 may be associated with a technician for the flameless heater system 100.

The data store 730 may be a persistent storage that is capable of storing data (e.g., parameters associated with a flameless heater system 100, as described herein). A persistent storage may be a local storage unit or a remote storage unit. Persistent storage may be a magnetic storage unit, optical storage unit, solid state storage unit, electronic storage units (main memory), or similar storage unit. Persistent storage may also be a monolithic/single device or a distributed set of devices.

In embodiments, data store 730 may be a central server or a cloud-based storage system including a processing device (not shown). The central server or the cloud-based storage system may be accessed by control system 710 and/or client device 750. Parameters from the flameless heater system 100 may be transmitted to the data store 730 for storage. In embodiments, upon receipt of the parameters, the data store 730 may transmit the parameters to client device 750. In some embodiments, the parameters stored at the data store may be accessed by client device 750 via a user interface. For example, the data store 730 may generate a graphical user interface (GUI) to present the parameters of the flameless heater system 100 to client device 750. In embodiments, client device 750 may provide adjustments to one or more parameters of the flameless heater system 100 to the data store 730. In some embodiments, upon receipt of the adjustments, the data store 730 may transmit the adjustments to the parameters to control system 710. In some embodiments, the adjustments to the parameters may be accessed by control system 710 via a user interface.

In embodiments, telematics component 729 may transmit parameters of a flameless heater system to client device 750. Telematics component 729 may receive, from client device 750, one or more adjustments to one or more parameters of the flameless heater system.

Figure 8:
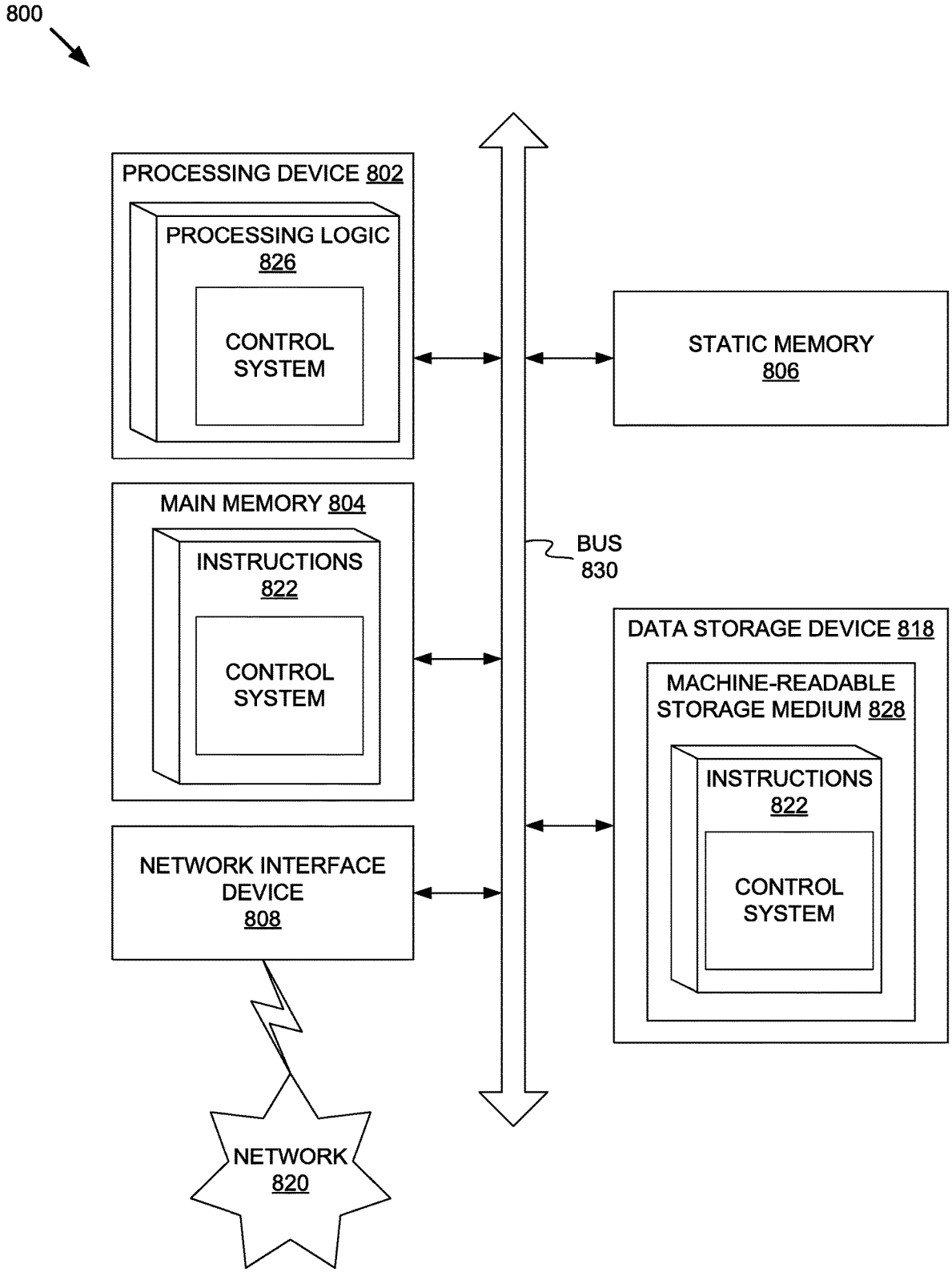
FIG. 8 illustrates a diagrammatic representation of a machine in the example form of a computer system.

FIG. 8 illustrates a diagrammatic representation of a machine in the example form of a computer system 800 within which a set of instructions, for causing the machine to perform any one or more of the methodologies discussed herein, may be executed. In alternative embodiments, the machine may be connected (e.g., networked) to other machines in a local area network (LAN), an intranet, an extranet, or the Internet. The machine may operate in the capacity of a server or a client machine in a client-server network environment, or as a peer machine in a peer-to-peer (or distributed) network environment. The machine may be a personal computer (PC), a tablet PC, a web appliance, a server, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. In one embodiment, computer system 800 may be representative of a server configured to control the operations of flameless heater system 100.

The exemplary computer system 800 includes a processing device 802, a user interface display 813, a main memory 804 (e.g., read-only memory (ROM), flash memory, dynamic random access memory (DRAM)), a static memory 806 (e.g., flash memory, static random access memory (SRAM), etc.), and a data storage device 818, which communicate with each other via a bus 830. Any of the signals provided over various buses described herein may be time multiplexed with other signals and provided over one or more common buses. Additionally, the interconnection between circuit components or blocks may be shown as buses or as single signal lines. Each of the buses may alternatively be one or more single signal lines and each of the single signal lines may alternatively be buses.

Processing device 802 represents one or more general-purpose processing devices such as a microprocessor, central processing unit, or the like. More particularly, the processing device may be complex instruction set computing (CISC) microprocessor, reduced instruction set computer (RISC) microprocessor, very long instruction word (VLIW) microprocessor, or processor implementing other instruction sets, or processors implementing a combination of instruction sets. Processing device 802 may also be one or more special-purpose processing devices such as an application specific integrated circuit (ASIC), a field programmable gate array (FPGA), a digital signal processor (DSP), network processor, or the like. The processing device 802 is configured to execute processing logic 826, which may be one example of system 100 as shown in FIG. 1, for performing the operations and blocks discussed herein.

The data storage device 818 may include a machine-readable storage medium 828, on which is stored one or more set of instructions 822 (e.g., software) embodying any one or more of the methodologies of functions described herein, including instructions to cause the processing device 802 to execute a control system (e.g., control system 160). The instructions 822 may also reside, completely or at least partially, within the main memory 804 or within the processing device 802 during execution thereof by the computer system 800; the main memory 804 and the processing device 802 also constitute machine-readable storage media. The instructions 822 may further be transmitted or received over a network 820 via the network interface device 808.

The machine-readable storage medium 828 may also be used to store instructions to perform a method for device identification, as described herein. While the machine-readable storage medium 828 is shown in an exemplary embodiment to be a single medium, the term "machine-readable storage medium" should be taken to include a single medium or multiple media (e.g., a centralized or distributed database, or associated caches and servers) that store the one or more sets of instructions. A machine-readable medium includes any mechanism for storing information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read-only memory (ROM); random-access memory (RAM); erasable programmable memory (e.g., EPROM and EEPROM); flash memory; or another type of medium suitable for storing electronic instructions.

The preceding description sets forth numerous specific details such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular embodiments may vary from these exemplary details and still be contemplated to be within the scope of the present disclosure.

Reference throughout this specification to "one embodiment" or "an embodiment" means that a particular feature, structure, or characteristic described in connection with the embodiments included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or".

Additionally, some embodiments may be practiced in distributed computing environments where the machine-readable medium is stored on and or executed by more than one computer system. In addition, the information transferred between computer systems may either be pulled or pushed across the communication medium connecting the computer systems.

Embodiments of the claimed subject matter include, but are not limited to, various operations described herein. These operations may be performed by hardware components, software, firmware, or a combination thereof.

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent or alternating manner.

The above description of illustrated implementations of the invention, including what is described in the Abstract, is not intended to be exhaustive or to limit the invention to the precise forms disclosed. While specific implementations of, and examples for, the invention are described herein for illustrative purposes, various equivalent modifications are possible within the scope of the invention, as those skilled in the relevant art will recognize. The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such. Furthermore, the terms "first," "second," "third," "fourth," etc. as used herein are meant as labels to distinguish among different elements and may not necessarily have an ordinal meaning according to their numerical designation.

What is claimed is:

1. A flameless heater system, comprising:

an energy source comprising a diesel engine configured to create volumes of air;

a hydraulic system to control engine loading for heat generation and for air moving;

a magnetic braking system comprising a pivoting magnet arm with an adjustable position that is adjustable relative to a rotating structure to change engine loading by changing a magnetic force exerted on the rotating structure by the pivoting magnet arm; and a control system, operatively coupled with the energy source and the hydraulic system to control a speed of the diesel engine by regulating a fuel burn rate, a loading of the diesel engine, and a fan speed to achieve an airflow over a range of static pressures, wherein the control system further comprises:

one or more air sensors operatively coupled to the control system, the one or more air sensors being configured to measure a velocity associated with the flameless heater system, wherein the one or more air sensors detect a quality of air by measuring an amount of particulate matter in a particular volume of space.

2. The flameless heater system of claim 1, wherein the magnetic braking system further comprises a magnet arm actuator coupled to the pivoting magnet arm, the magnet arm actuator to position the pivoting magnet arm to exert a desired magnetic force on the rotating structure by adjusting a distance between the pivoting magnetic arm and the rotating structure.

3. The flameless heater system of claim 2, wherein the rotating structure comprises rotating disks that are interleaved between magnets of the pivoting magnet arm.

4. The flameless heater system of claim 1, further comprising:

a speed system comprising a variable speed hydraulic motor, the variable speed hydraulic motor to independently adjust a rotational speed of a rotating structure.

5. The flameless heater system of claim 1, wherein the hydraulic system further comprises:

one or more hydraulic pumps coupled to the diesel engine, the one or more hydraulic pumps to control the fuel burn rate of the flameless heater system.

6. The flameless heater system of claim 1, further comprising:

an air system comprising a fan and a variable speed hydraulic fan motor, the fan to facilitate air moving within the flameless heater system and the variable speed hydraulic fan motor to control fan speed of the fan.

7. The flameless heater system of claim 1, further comprising:

a temperature monitoring system to measure one or more of an air inlet temperature, a cabinet temperature, a fan inlet temperature, a discharge air temperature, or a remote probe temperature.

8. The flameless heater system of claim 1, further comprising:

a heat transfer system, the heat transfer system to move a heated volume of air from the diesel engine.

9. The flameless heater system of claim 8, wherein the heat transfer system is configured to move the heated volume of air from one or more of a heating system, an air system, the hydraulic system, a speed system, a braking system, a temperature system, the heat transfer system, or the control system.

10. The flameless heater system of claim 1, further comprising:

a telematics system operatively coupled to the control system, the telematics system to transmit and receive parameters associated with the flameless heater system.

11. The flameless heater system of claim 1, further comprising:

an alternator to convert energy produced by the diesel engine into electricity.

12. The flameless heater system of claim 1, wherein the control system further comprises:

one or more hydraulic sensors operatively coupled to the control system, the one or more hydraulic sensors being configured to measure a velocity or a pressure associated with the flameless heater system;

one or more speed sensors operatively coupled to the control system, the one or more speed sensors being configured to measure a speed of a rotating structure associated with the flameless heater system;

one or more braking sensors operatively coupled to the control system, the one or more braking sensors being configured to measure an amount of engine loading associated with the flameless heater system; and one or more temperature sensors operatively coupled to the control system, the one or more temperature sensors being configured to measure one or more temperatures associated with the flameless heater system.

* * * * *